US008053157B2

(12) United States Patent
Jung et al.

(10) Patent No.: US 8,053,157 B2
(45) Date of Patent: Nov. 8, 2011

(54) METHOD FOR MANUFACTURING A TONER HAVING GOOD CHARGING CHARACTERISTICS

(75) Inventors: Woo-Cheul Jung, Ulsan (KR); Ji-Hoon Lee, Daejeon (KR); Hui-Je Lee, Incheon (KR); Yu-Na Kim, Daejeon (KR); Jung-Woo Kim, Daejeon (KR); Chang Soon Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 12/226,218

(22) PCT Filed: Dec. 14, 2007

(86) PCT No.: PCT/KR2007/006535

§ 371 (c)(1),
(2), (4) Date: Oct. 10, 2008

(87) PCT Pub. No.: WO2008/072925

PCT Pub. Date: Jun. 19, 2008

(65) Prior Publication Data

US 2009/0246673 A1 Oct. 1, 2009

(30) Foreign Application Priority Data

Dec. 15, 2006 (KR) ..... 10-2006-0128996

(51) Int. Cl.
*G03G 9/093* (2006.01)

(52) U.S. Cl. ..... 430/137.13

(58) Field of Classification Search ..... 430/137.13, 430/110.2

See application file for complete search history.

(56) References Cited

U.S. PATENT DOCUMENTS

| | | | | |
|---|---|---|---|---|
| 5,952,144 | A * | 9/1999 | Hasegawa et al. | 430/110.2 |
| 6,033,822 | A * | 3/2000 | Hasegawa et al. | 430/137.11 |
| 6,136,490 | A * | 10/2000 | Ogawa et al. | 430/137.12 |
| 6,200,718 | B1 * | 3/2001 | Takasaki et al. | 430/110.2 |
| 6,365,313 | B1 | 4/2002 | Masuo et al. | |
| 2003/0215729 | A1 * | 11/2003 | Kim et al. | 430/108.1 |
| 2006/0099530 | A1 | 5/2006 | Lee et al. | |

FOREIGN PATENT DOCUMENTS

| | | |
|---|---|---|
| CN | 1842750 A | 10/2006 |
| JP | 3-015858 | 1/1991 |
| JP | 3-243954 | 10/1991 |
| JP | 2003-098723 | 4/2003 |
| KR | 10-2004-0074709 | 8/2004 |
| WO | WO 2006/095995 | 9/2006 |

* cited by examiner

*Primary Examiner* — Hoa Le

(74) *Attorney, Agent, or Firm* — McKenna Long & Aldridge LLP

(57) ABSTRACT

There is provided a toner having good charging characteristics that is composed of a core region and a thin shell in which a charge control agent is densely distributed so as to improve charging characteristics of the toner, and a method for manufacturing the same. The method for manufacturing a toner having a bi-layered structure includes: producing a toner core using a suspension polymerization method; preparing a suspension of toner particles having a core-shell structure by forming a rigid shell on a surface of the toner core; and recovering the toner particles from the suspension as a post-processing operation.

16 Claims, No Drawings

METHOD FOR MANUFACTURING A TONER HAVING GOOD CHARGING CHARACTERISTICS

This application is an application based on International Patent Application No. PCT/KR2007/006535 filed Dec. 14, 2007, which claims the benefit of Korean Application No. 10-2006-0128996 filed Dec. 15, 2006, which are hereby incorporated by reference for all purposes as if fully set forth herein.

TECHNICAL FIELD

The present invention relates to a toner having good charging characteristics and a method for manufacturing the same, and more particularly, to a toner that is composed of a core region and a thin shell in which a charge control agent is densely distributed so as to improve charging characteristics of the toner, and a method for manufacturing the same.

BACKGROUND ART

Recently, there have been increasing demands for a copying machine and a laser printer along with the wide distribution of Personal Computers (PCs) and the office automation. Both the copying machine and the laser printer are image forming apparatuses that display a desired image on a printing paper by transferring a toner on the printing paper, and thus essentially uses toner to form an image.

Generally, toner is a developer material that is used for development of electronic photographs, and used for printers or copying machines to develop an image on an image receptor in a transfer operation. Printing or copying processes of using toner in the copying machines or the laser printers are described as follows.

1. First, a charging step of uniformly charging a surface of a drum is performed. An Organic Photo Conductor (OPC) drum and the like are generally used as the drum, and the charging is conducted by electrostatically charging the drum surface using a charging rayon brush and the like.

2. Then, an exposure step of forming an electrostatic latent image by exposing the drum surface is followed. A charged body such as an organic photo conductor (OPC) on the uniformly charged drum surface functions as an insulator when light is not incident on the drum surface, but functions as a conductor for conducting charges in the presence of light. Thus, when the drum surface is exposed to the light such as laser beams, only the light-exposed portion is discharged or neutralized.

3. Apart from the exposure step, a step of attaching a toner to a surface of a developer roller is carried out. This is a preliminary step, followed by a step of developing a toner image on the charged drum.

4. Subsequently, performed is a development step of developing the latent image on the surface of the drum with the toner attracted to a surface of the previously prepared developer roller, thereby forming an image. As described above, when the drum surface is exposed to light, the exposed portion thereof is discharged or neutralized. This is why, when the toner is charged with the same polarity as that of the drum surface, the no-exposed portion of the drum surface will repel toner to prevent toner from being transferred onto the latent image. However, the toner may adhere to the latent image in a desired image shape since the exposed portion of the drum surface does not repel toner.

5. After the development step, a step of transferring the toner image from the drum surface to an image-receiving paper (i.e., a printing paper) is performed. In the transfer step, a surface of the image-receiving paper is charged with a polarity opposite to that of the toner to generate an attraction force between the toner and the image-receiving paper, and the drum and the image-receiving paper are placed adjacent to each other in order to facilitate the transferring operation.

6. The toner is not permanently bonded to the image-receiving paper even though it is transferred to the image-receiving paper. Therefore, a fusion step of fusing the toner to the image-receiving paper is followed. The fusion step is generally carried out by pressing the toner with heat and pressure while allowing the image-receiving paper, on which the toner image is formed, to pass between a pair of rollers including a heat roller and a pressure roller, and forming a coating layer around the toner using a binder in the toner.

7. Finally, prior to the recharging of the drum, a step of cleaning residual toner from the surface of the drum is carried out to charge the drum again for the next process cycle.

As seen from the printing or copying process, one important principle used in the printing or copying using a toner is to use charged toner. That is, since toner is charged by a developer roller and a doctor blade, a surface of the toner gains electric charges, and the charged toner is developed onto a photoconductive drum in a pattern to be printed according to the charge state in a surface of the photoconductive drum, and transferred from the photoconductive drum to an image-receiving paper. If the toner has poor charging characteristics, it is difficult to easily perform the development or transfer operations, which makes it difficult to realize a desired image having a high resolution.

Accordingly, it is important in the fields of producing toner to provide toner having excellent charging characteristics.

The charging characteristics of toner are realized by a charge control agent (abbreviated "CCA") in the toner. The charging characteristics of toner become more excellent as the toner is in easy friction with a doctor blade.

The methods of producing toner are mainly divided into two categories. One of them is to melt and mix (knead) toner materials and mechanically pulverize the resulting mixture to produce a toner having a fine particle size, which is called a melt-mixing method, and the other method is to finely dispersing toner materials in a dispersion medium such as water to prepare a suspension and polymerizing the suspended colloidal particles to produce toner particles, which is called a polymerization method.

The melt-mixing process has been widely known up to now, and toner core particles prepared by the melt-mixing process have very irregular shapes such as acute edges, as well as irregular size and morphology. When the toner core particles have such irregular shapes, different pressures from a doctor blade are applied to the toner core particles, which leads to the different frictional forces generated in the toner core particles. Therefore, the toner particles prepared by the melt-mixing method do not have good charging characteristics or flowability.

The polymerization method is developed to solve the above problems regarding the melt-mixing process, and has advantages that it is possible to produce particles that are more regular and spherical than the toner core particles prepared by the melt-mixing method.

However, a charge control agent in the toner core particles is generally uniformly distributed regardless of the location of the toner core particles although the toner core particles are manufactured according to this polymerization method. However, since the charging of toner is carried out through frictions between a doctor blade and a charge control agent disposed onto a surface of the toner, the charge control agent that is distributed in a remote central region of the toner does not participate in the charging of the toner particles in the case of the toner in which the charge control agent is distributed uniformly as described above, resulting in the seriously deteriorated efficiency of the charge control agent.

Of course, the charge control agent may be mainly distributed in a surface of toner, or locally distributed in a surface of toner, depending on the structure and characteristics of the used charge control agents. However, the kind of used charge control agents needs to be defined so as to manufacture a toner in which the charge control agents are distributed intensively, and therefore charge control agents also need to be developed to coincide with the manufacture of toner. Also, the development of these charge control agents means that a larger amount of the charge control agent is distributed in a surface of toner than a central region of the toner, but the entire charge control agent is not present in a surface region of the toner, and therefore problems about the efficacy of the charge control agent remain to be solved.

DISCLOSURE OF INVENTION

Technical Problem

An object of the present invention is to provide a method for manufacturing a toner having good charging characteristics capable of improving charging characteristics of toner by controlling a charge amount of the toner with conventional charge control agents other than a new kind of charge control agents so that all of the charge control agent can be distributed outside the toner by modifying the addition sequence of the charge control agent and the manufacturing process when the toner is manufactured according to a polymerization process.

Another object of the present invention is to provide a toner having good charging characteristics manufactured by the method, wherein the toner has a bi-layered structure.

Technical Solution

According to an aspect of the present invention, there is provided a method for manufacturing a toner having a bi-layered structure, the method including: producing a toner core using a suspension polymerization method; preparing a suspension of toner particles having a core-shell structure by forming a rigid shell on a surface of the toner core; and recovering the toner particles from the suspension as a post-processing operation.

Here, the producing of the toner core may include: adding a dispersant and optionally an anionic surfactant to an aqueous solution so that raw materials for a toner core are present as fine colloidal particles prior to a polymerization process and preparing a monomer complex through a separate operation; adding the monomer complex to the aqueous solution; and pulverizing the monomer complex into fine colloidal particles by applying a shearing force to the monomer complex in the aqueous solution and simultaneously polymerizing the pulverized fine colloidal particles.

Also, the dispersant may be one or two or more selected from the group consisting of inorganic dispersants such as calcium phosphate salt, magnesium salt, hydrophilic silica, hydrophobic silica and colloidal silica; or non-ionic polymeric dispersants such as polyoxyethylene alkylether, polyoxyalkylene alkylphenolether, sorbitan fatty acid ester, polyoxyalkylene fatty acid ester, glycerine fatty acid ester, polyvinyl alcohol, alkyl cellulose and polyvinyl pyrrolidone; and ionic polymeric dispersants such as polyacrylamide, polyvinyl amine, polyvinyl amine N-oxide, polyvinyl ammonium salt, polydialkyldiallyl ammonium salt, polyacrylic acid, polystyrene sulfonic acid, polyacrylate, polystyrene sulfate and polyaminoalkyl acrylate.

And, the dispersant may be added in a content of 0.1 to 10% by weight, based on the total weight of the aqueous solution.

Also, the anionic surfactant may be one or two or more selected from the group consisting of fatty acid salt, alkyl sulfuric ester salt, alkylaryl sulfuric ester salt, dialkyl sulfosuccinate and alkyl phosphate.

Furthermore, the anionic surfactant may be present in a content of 0 to 20% by weight, based on the total weight of the aqueous solution.

And, the monomer complex may include 30 to 90% by weight of an aromatic vinyl monomer, 5 to 30% by weight of one or two or more selected from the group consisting of acrylate monomer, methacrylate monomer and dien monomer, 0 to 30% by weight of an acidic or basic olefin monomer, 0.1 to 8% by weight of a molecular weight modifier, 1 to 20% by weight of a color pigment or carbon black, 0.01 to 30% by weight of wax, 0.001 to 10% by weight of a polar grafting agent, and 0.01 to 5% by weight of a polymerization initiator.

Here, the aromatic vinyl monomer may include styrene, monochlorostyrene, methylstyrene, dimethylstyrene, etc., and they may be used alone or in combinations thereof.

Also, the acrylate monomer may include methylacrylate, ethylacrylate, n-butylacrylate, isobutylacrylate, dodecyl acrylate, 2-ethylhexylacrylate, etc., the methacrylate monomer may include methyl methacrylate, ethyl methacrylate, n-butyl methacrylate, isobutyl methacrylate, dodecyl methacrylate, 2-ethylhexyl methacrylate, etc., and the dien monomer may include butadien, isoprene, etc., and they may be used alone or in combinations thereof.

The acidic olefin monomer may include $\alpha,\beta$-ethylene compounds containing a carboxyl group, and the basic olefin monomer may include methacrylic acid esters, methacryl amides, vinyl amines, and diaryl amines of aliphatic alcohol containing amine or quaternary ammonium group; and ammonium salts thereof, and they may be used alone or in combinations thereof.

Also, the molecular weight modifier may be one or two or more selected from the group consisting of mercaptan compounds including t-dodecyl mercaptan and n-dodecyl mercaptan.

Furthermore, the pigment may be one or two or more selected from the group consisting of inorganic pigments such as metal powder type pigment, metal oxide type, carbon, sulfide type, chromate type and ferrocyanide type pigments; and organic pigments such as azo type, acid dye type, basic dye type, mordant dye type, phthalocyanine type, quinacridone type and dioxane type pigments.

Also, the wax may be one or two or more selected from the group consisting of petroleum-refined wax such as paraffin wax, microcrystalline wax and ceresin wax; natural wax such as carnuba wax; and synthetic wax such as polyethylene and polypropylene.

And, the polar grafting agent may be one or two or more selected from the group consisting of ethylene dimethacrylate, ethylene glycol dimethacrylate, diethylene glycol diacrylate, 1,6-hexamethylene diacrylate, allyl methacrylate, 1,1,1-trimethylol propane triacrylate and triallylamine.

And, the polymerization initiator, which may used herein, includes oil-soluble initiators and water-soluble initiators. Representative examples of the polymerization initiator include azo initiators such as bisisobutyronitrile, azobisdimethylvaleronitrile, etc.; organic peroxides such as benzoyl peroxide, lauroyl peroxide, etc.; and conventional water-soluble initiators such as potassium persulfate, ammonium persulfate, etc.

Also, the monomer complex may be prepared by kneading all components except for the polymerization initiator, followed by further adding the polymerization initiator right before the suspension polymerization and kneading the resulting mixture.

Also, the shell may be prepared by adding 1 to 20 parts by weight of a monomer (an additionally added monomer), 0 to 5 parts by weight of a crosslinking agent and 0.01 to 20 parts by weight of a charge control agent (CCA) (based on 100 parts by weight of the toner core), and 0.01 to 5 parts by weight of a polymerization initiator (based on 100 parts by weight of the monomer) to the suspension in which the toner core is formed; and reacting the resulting mixture while stirring.

And, the monomer may be one or two or more selected from the group consisting of aromatic vinyl, acrylate and methacrylate monomers.

Also, the aromatic vinyl monomer may be selected from the group consisting of styrene, monochlorostyrene, methylstyrene and dimethylstyrene.

Also, the acrylate monomer may be selected from the group consisting of methylacrylate, ethylacrylate, n-butylacrylate, isobutylacrylate, dodecyl acrylate and 2-ethylhexylacrylate.

And, the methacrylate monomer may be selected from the group consisting of methyl methacrylate, ethyl methacrylate, n-butyl methacrylate, isobutyl methacrylate, dodecyl methacrylate and 2-ethylhexyl methacrylate.

Also, the monomer may be present in a content of 1 to 20 parts by weight, based on 100 parts by weight of the toner core.

And, the crosslinking agent may be one or both of divinylbenzene and arylmethacrylate.

And, the charge control agent may be one or two or more selected from the group consisting of cationic charge control agents such as nigrosine dye, highly aliphatic metal salt, alkoxy amine, chelate, quaternary ammonium salt, alkylamide, fluorinated surfactant, metal salt of naphthalenic acid, etc.; anionic charge control agents such as chlorinated paraffin, polyester, sulfonylamine of copper phthalocyanine, styrene-acryl polymer containing sulfonic acid group, etc.; and inorganic anionic charge control agents such as chromium-containing azo metal complex, salicylic acid metal complex and chromium-containing organic dye.

Also, the polymerization initiator may be one or two or more selected from the group consisting of azo initiators such as bisisobutyronitrile and azobisdimethylvaleronitrile.

And, the post-processing operation may include: separating the toner from the suspension by repeatedly washing the suspension including the toner with a core-shell structure to remove the dispersant from the suspension and filtering the dispersant-free suspension; and drying the toner in a vacuum oven.

According to another aspect of the present invention, there is provided a toner having good charging characteristics that has a toner core-shell bi-layered structure composed of a toner core and a shell layer formed on a surface of the toner core.

In this case, the toner core may be prepared by polymerizing a monomer complex comprising 30 to 90% by weight of a vinyl monomer, 5 to 70% by weight of one or two or more selected from the group consisting of acrylate monomer, methacrylate monomer and dien monomer, 0 to 30% by weight of an acidic or basic olefin monomer, 0.1 to 8% by weight of a molecular weight modifier, 1 to 20% by weight of a color pigment or carbon black, 0.01 to 30% by weight of wax, 0.001 to 10% by weight of a polar grafting agent, and 0.01 to 5% by weight of a polymerization initiator.

Also, the shell layer of the toner may be formed by coating the toner core with 1 to 20 parts by weight of a monomer (an additionally added monomer), 0 to 5 parts by weight of a crosslinking agent and 0.01 to 20 parts by weight of a charge control agent (CCA) (based on 100 parts by weight of the toner core), and 0.01 to 5 parts by weight of a polymerization initiator (based on 100 parts by weight of the monomer) and polymerizing the coated toner core.

BEST MODE FOR CARRYING OUT THE INVENTION

Hereinafter, the present invention will be described in more detail.

The present inventors have made ardent attempts based on the fact that it is difficult to effectively prevent a considerable amount of a charge control agent from being distributed in a central region of toner when all components of the toner are added together with the charge control agent to polymerize the toner, and found that it is possible to obtain a toner that is composed of a toner core in which the charge control agent is nearly not present and a shell having a high density of the charge control agent when a toner is polymerized from the core and its shell is formed to produce a toner having a bi-layered structure of a core and a shell layer.

To obtain this toner, it is preferred to produce a toner core using a suspension polymerization method and form a rigid shell on a surface of the core.

The manufacturing method of toner is divided into an operation of producing a toner core and an operation of forming a shell, and each of operations will be described in detail.

The process of producing a toner core is carried out by adding a dispersant and optionally a surfactant to water in a reactor to prepare an aqueous phase, the dispersant functioning so that raw materials (a monomer mixture) for a toner core can be dispersed as a certain size of droplets into a water system prior to a polymerization process; preparing a monomer mixture in a respective operation; adding the monomer complex to the aqueous phase; and polymerizing a toner core by applying a shearing force to the monomer mixture in the aqueous phase. This polymerization method is called a suspension polymerization method. In this case, one example of the suspension polymerization method is to polymerize toner core particles at a reaction temperature of 60° C. and a shearing force of 100 rpm for 10 hours.

The dispersant includes inorganic dispersants such as calcium phosphate salt, magnesium salt, hydrophilic silica, hydrophobic silica and colloidal silica; or non-ionic polymeric dispersants such as polyoxyethylene alkylether, polyoxyalkylene alkylphenolether, sorbitan fatty acid ester, polyoxyalkylene fatty acid ester, glycerine fatty acid ester, polyvinyl alcohol, alkyl cellulose and polyvinyl pyrrolidone; and ionic polymeric dispersant such as polyacrylamide, polyvinyl amine, polyvinyl amine N-oxide, polyvinyl ammonium salt, polydialkyldiallyl ammonium salt, polyacrylic acid, polystyrene sulfonic acid, polyacrylate, polystyrene sulfate and polyaminoalkyl acrylate, and they may be used alone or in combinations thereof. The dispersant is preferably added in a content of 0.1 to 10% by weight, based on the total weight of the aqueous solution. When the content of the added dispersant is less than 0.1% by weight, a dispersion effect is not achieved sufficiently. On the contrary, when the content of the added dispersant exceeds 10% by weight, suspended particles are increasingly formed due to the increase in side reactions, which adversely affects physical properties of the final toner.

Also, the anionic surfactant, which is added optionally, is preferably at least one selected from the group consisting of fatty acid salt, alkyl sulfuric ester salt, alkylaryl sulfuric ester salt, dialkyl sulfosuccinate and alkyl phosphate. The anionic surfactant is preferably is present in a content of 0 to 20% by weight, based on the total weight of the aqueous solution.

When the content of the anionic surfactant exceeds 20% by weight, side reactions may also be increasingly likely to occur.

Also, the monomer complex includes 30 to 90% by weight of an aromatic vinyl monomer, 5 to 30% by weight of one or two or more selected from the group consisting of acrylate monomer, methacrylate monomer and dien monomer, 0 to 30% by weight of an acidic or basic olefin monomer, 0 to 8% by weight of a molecular weight modifier, 1 to 20% by weight of a color pigment or carbon black, 0.01 to 30% by weight of wax, 0.001 to 10% by weight of a polar grafting agent, and 0.01 to 5% by weight of a polymerization initiator.

The components and their contents that form the monomer complex are described in detail, as follows.

Here, the aromatic vinyl monomer includes styrene, monochlorostyrene, methylstyrene, dimethylstyrene, and the like, and they may be used alone or in combinations thereof. The aromatic vinyl monomer is preferably used in a content of 30 to 90% by weight, based on the total weight of the monomer mixture. A reason for limiting the content of the aromatic vinyl monomer to a content range of 30 to 90% by weight is generally to adjust a classification temperature (Tg) of a polymerized toner. In this case, when the content of the aromatic vinyl monomer is less than 30% by weight, a glassification temperature (Tg) of toner is too low, and therefore the toner is attached to a fusing roller in a printing process, which leads to the hot-offset problem. On the contrary, when the content of the aromatic vinyl monomer exceeds 90% by weight, a glassification temperature (Tg) of toner is too high, and therefore fusion ability of the toner may be deteriorated since the toner is insufficiently fused in the printing process.

Also, the acrylate monomer includes methylacrylate, ethylacrylate, n-butylacrylate, isobutylacrylate, dodecyl acrylate, 2-ethylhexylacrylate, etc. Here, the methacrylate monomer includes methyl methacrylate, ethylmethacrylate, n-butyl methacrylate, isobutyl methacrylate, dodecyl methacrylate, 2-ethylhexyl methacrylate, etc., and the dien monomer includes butadien, isoprene, etc., and they may be used alone or in combinations thereof. The acrylate monomer is preferably used in a content of 5 to 30% by weight, based on the total weight of the monomer mixture. Here, a reason for limiting the content of the acrylate monomer to a content range of 5 to 30% by weight is to prevent problems that may be caused in the printing process by adjusting a glassification temperature of a toner to a suitable extent, as described above in the aromatic vinyl monomer.

The acid olefinic monomer includes α,β-ethylene compounds containing a carboxyl group, and the basic olefinic monomer includes methacrylic acid esters, methacryl amides, vinyl amines, and diaryl amines of aliphatic alcohol containing amine or quaternary ammonium group, and ammonium salts thereof, and they may be used alone or in combinations thereof. The acid olefinic monomer and the basic olefinic monomer are preferably present in a content of 0 to 30% by weight, based on the total weight of the monomer mixture. The acid olefinic monomer and the basic olefinic monomer are added to improve charging characteristics of a toner surface. In this case, when the content of the olefinic monomer exceeds 30% by weight, reaction stability in the polymerization of toner may be degraded, and therefore a large amount of toner particles may be agglomerated after the polymerization of toner.

The molecular weight modifier is added to improve fusion ability of toner in a printing process by reducing molecular weight of toner core particles to adjust a glassification temperature of the toner core particles, and it may not be added, if necessary. Because the molecular weight modifier is added when the toner has poor fusion ability, the content of the molecular weight modifier is determined according to the fusion ability of the toner. Therefore, there is no particular limitation on the content of the molecular weight modifier, as described above. However, the molecular weight modifier is generally added in a content of approximately 0 to 8% by weight. When the molecular weight modifier is added in an excessive amount, a glassification temperature of the toner core particles is too low, which leads to the hot-offset problem. One or two or more selected from the group consisting of mercaptan compounds, for example t-dodecyl mercaptan and n-dodecyl mercaptan are preferably used as the molecular weight modifier.

And, the coloring agent such as a color pigment or carbon black is added to give colors to the toner. Because the coloring agent does not highly affect glassification temperature of toner core particles, there is no particular limitation on the content of the coloring agent if the coloring agent may express desired colors, but the content of the coloring agent is generally used in a content of 0.1 to 20% by weight. The pigment includes inorganic pigments such as metal powder type pigment, metal oxide type, carbon type, sulfide type, chromate type and ferrocyanide type pigments; and organic pigments such as azo type, acid dye type, basic dye type, mordant dye type, phthalocyanine type, quinacridone type and dioxane type pigments, and they may be preferably used alone or in combinations thereof.

The wax is added to give gloss to printouts after the printing of toner and fix the toner at a low temperature by reducing a melting point of the toner. There is no particular limitation on the content of the wax, but the wax may be added in a suitable amount, if necessary, as described above. In general, the wax is present in a content of approximately 0.01 to 30% by weight. The wax includes petroleum-refined wax such as paraffin wax, microcrystalline wax and ceresin wax; natural wax such as carnuba wax; and synthetic wax such as polyethylene and polypropylene, and they may be used alone or in combination thereof.

The polar grafting agent is added to function as a crosslinking agent and easily form a shell in a core-shell formation at the same time. Here, the polar grafting agent is preferably present in a content of 0.001 to 10% by weight. The polar grafting agent includes ethylene dimethacrylate, ethylene glycol dimethacrylate, diethylene glycol diacrylate, 1,6 hexamethylene diacrylate, allyl methacrylate, 1,1,1-trimethylol propane triacrylate, triallylamine, etc., and they may be used alone or in combinations thereof.

Meanwhile, when the content of the polar grafting agent is less than 0.001% by weight, a hard shell that is formed on a core is not formed suitably. On the contrary, when the content of the polar grafting agent exceeds 10% by weight, the core is highly gelated, which leads to the degraded fusion ability of toner.

An oil-soluble initiator and a water-soluble initiator may be used as the polymerization initiator. Representative examples of the polymerization initiator include an azo initiator such as bisisobutyronitrile, azobisdimethylvaleronitrile, etc.; organic peroxide such as benzoyl peroxide, lauroyl peroxide, etc.; a conventional water-soluble initiator such as potassium persulfate, ammonium persulfate, etc. The polymerization initiator is preferably used in an amount of 0.01 to 5% by weight, based on the total weight of the monomer mixture. In this case, when the amount of the polymerization initiator is less than 0.01 parts by weight, non-reacted compounds remain in the monomer mixture, whereas reaction stability of toner may be deteriorated due to the excessively rapid reaction rate when the amount of the polymerization initiator exceeds 5% by weight.

Toner core particles are manufactured from the monomer complex having the above-mentioned compositions according to the conventional suspension polymerization methods. In this case, the monomer complex may be prepared by mixing (kneading) all components simultaneously. In order to prevent polymerization of the components from being initiated before the suspension polymerization, it is more preferred to mix (knead) all components except for the polymerization initiator and add the polymerization initiator right before the suspension polymerization.

When the aqueous solution and the monomer complex are prepared, followed is an operation of pulverizing the monomer complex into fine particles by applying a shearing force to the monomer complex in the aqueous solution and polymerizing the pulverized fine particles while suspending the fine particles. In this case, the shearing force may be applied in a manner where an impeller is rotated at a suitable rotational speed in a reactor. A polymerization temperature may be varied according to the used polymerization initiators, but the polymerization temperature is generally maintained to a temperature of about 50 to 90° C. Also, the rotational speed of the impeller is generally set to a range of 10 to 700 rpm the impeller is rotated to give a shearing force. As a subsequent process, an operation of obtaining toner particles from the suspension needs to be followed.

According to the above-mentioned method according to the present invention, it is possible to obtain a desired toner core. Then, it is necessary to form a rigid shell, in which the charge control agent is densely distributed, on the toner core.

The rigid shell may be prepared into a shell shape by adding 1 to 20 parts by weight of a monomer (an additionally added monomer), 0 to 5 parts by weight of a crosslinking agent and 0.01 to 20 parts by weight of a charge control agent (CCA) (based on 100 parts by weight of the toner core), and 0.01 to 5 parts by weight of a polymerization initiator (based on 100 parts by weight of the monomer) to the suspension in which the toner core is formed; and reacting the resulting mixture while stirring. As a result, it is possible to obtain a toner having a core-shell structure. In this case, the additionally added monomer, the crosslinking agent, the charge control agent, the polymerization initiator and the like are preferably previously mixed prior to the addition to the suspension.

Here, the monomer preferably includes aromatic vinyl, acrylate, or methacrylate monomers, and they may be used alone or in combinations thereof.

The aromatic vinyl monomer includes styrene, monochlorostyrene, methylstyrene, dimethylstyrene, and the like, and the acrylate monomer includes methylacrylate, ethylacrylate, n-butylacrylate, isobutylacrylate, dodecyl acrylate, 2-ethylhexylacrylate, and the like, and the methacrylate monomer includes methyl methacrylate, ethyl methacrylate, n-butyl methacrylate, isobutyl methacrylate, dodecyl methacrylate, 2-ethylhexyl methacrylate, and the like. They may be used alone or in combinations thereof to form a toner shell according to the present invention.

The monomers are major components for forming a shell of a toner core, and a hydrophobic shell is formed by the presence of the monomers. The presence of this hydrophobic shell layer functions to adjust a location of the charge control agent so that the charge control agent can be distributed only in the shell. Also, the presence of the hydrophobic shell layer makes it possible to effectively prevent the absorption of moisture into toner which degrades charging characteristics, under the long-term preservation of toner.

In this case, the additionally added monomer is preferably present in a content of 1 to 20 parts by weight, based on 100 parts by weight of the toner core. A reason for limiting the content of the additionally added monomer to a content range of 1 to 20 parts by weight is why a thickness of a shell in the polymerized toner is determined by the amount of the additionally added monomer. That is, when the content of the monomer exceeds 20 parts by weight, a shell layer is too thick, which makes it difficult for the charge control agent to effectively exhibit charging characteristics due to the friction against a developer roller in the printing process. Also, when the content of the monomer is less than 1 part by weight based on 100 parts by weight of the toner core, a shell is not sufficiently formed on a surface of the toner.

The crosslinking agent is added to increase resistance to moisture during the storage of the toner by crosslinking a shell (the outermost layer) of the toner, or prevent toner from being melted by the local frictional heat when toner is passed through doctor blades in a developing machine. The crosslinking agent used herein preferably includes divinylbenzene, aryl methacrylate, etc. The crosslinking agent is preferably present in a content of 0 to 5% by weight, based on 100 parts by weight of the toner core. When the content of the crosslinking agent exceeds 5% by weight based on 100 parts by weight of the toner core, the toner is highly gelated, which leads to the degraded fusion ability of toner during the printing process. Therefore, it is preferred to limit the content of the crosslinking agent to a content range of 5% by weight or less. Since the crosslinking agent may be optionally added, the lowest limit of the crosslinking agent is set to 0% by weight.

The charge control agent includes a cationic charge control agent, for example nigrosine dye, highly aliphatic metal salt, alkoxy amine, chelate, quaternary ammonium salt, alkylamide, fluorinated surfactant, metal salt of naphthalenic acid, etc.; an anionic charge control agent, for example chlorinated paraffin, polyester, sulfonylamine of copper phthalocyanine, styrene-acryl polymer containing sulfonic acid group, etc; or an inorganic anionic charge control agent, for example chromium-containing azo metal complex, salicylic acid metal complex, chromium-containing organic dye, etc., and they may be used alone or in combinations thereof. The charge control agent is preferably present in a content of 0.01 to 20% by weight, based on 100 parts by weight of the toner core. When the content of the charge control agent is less than 0.01% by weight, the toner does not have a sufficient charge density in a printing process, whereas, when the content of the charge control agent exceeds 20% by weight, the toner has an excessive charge density, which leads rather to the degraded image quality in the printing process.

An oil-soluble initiator that may be melted into monomers may be used as the polymerization initiator used to form a shell in the polymerization reaction. Exemplary examples of the polymerization initiator include azo initiators such as bisisobutyronitrile, azobisdimethylvaleronitrile, etc. The polymerization initiator is preferably used in an amount of 0.01 to 5% by weight, based on 100 parts by weight of the added monomer. Here, when the amount of the polymerization initiator is less than 0.01 parts by weight, non-reacted compounds remain in the monomer mixture, whereas reaction stability of toner may be deteriorated due to the excessively rapid reaction rate when the amount of the polymerization initiator exceeds 5% by weight.

By employing the above-mentioned process, it is possible to prepare a suspension of toner particles including a toner core and a shell formed on the toner core (a toner core-shell structure). As a subsequent process, an operation of obtaining toner particles from the suspension needs to be followed.

For the subsequent process, a dispersant is removed from the suspension including the toner particles having a core-shell structure as prepared in the previous operation, by washing the suspension with distilled water, and the suspension is then repeatedly washed and filtered to separate a toner, and the toner is dried at a room temperature in a vacuum oven to obtain final toner particles. The toner core particles are dried until their moisture content is about 0.7%. Here, the drying time may be varied according to the crosslinking level or the materials to be crosslinked. In general, the drying time is set to a range of 24 to 28 hours, but the present invention is not particularly limited thereto.

The toner particles of the present invention prepared through the above-mentioned process is a toner having a toner core-shell bi-layered structure, which is composed of a toner core and a shell layer formed on a surface of the toner core.

As described above, the toner core layer is prepared by polymerizing a monomer complex including 30 to 90% by weight of a vinyl monomer, 5 to 70% by weight of one or two or more selected from the group consisting of acrylate monomer, methacrylate monomer and dien monomer, 0 to 30% by weight of an acidic or basic olefin monomer, 0.1~8% by weight of a molecular weight modifier, 1 to 20% by weight of a color pigment or carbon black, 0.01 to 30% by weight of wax, 0.001 to 10% by weight of a polar grafting agent, and 0.01 to 5% by weight of a polymerization initiator. Each of the components, which are added to produce the toner core, has been described above in detail.

Also, the toner shell layer in the toner particles of the present invention may be formed by coating the toner core with 1 to 20 parts by weight of a monomer (an additionally added monomer), 0 to 5 parts by weight of a crosslinking agent and 0.01 to 20 parts by weight of a charge control agent (CCA) (based on 100 parts by weight of the toner core), and 0.01 to 5 parts by weight of a polymerization initiator (based on 100 parts by weight of the monomer); and polymerizing the coated toner core. Also, each of the components, which are added to form the toner shell, has been described above in detail.

As a result, it is possible to produce a toner having good charging characteristics since the charge control agent is hardly distributed in the toner core but densely distributed in the shell layer.

Also, it is evident to those skilled in the art that various external additives, which are added to produce a toner, may be introduced into an external surface of the toner according to the present invention. The external additives that have been developed and proposed in the art may be used in the present invention regardless of the kind of the external additives, depending on the use of the external additives.

Hereinafter, exemplary embodiments of the present invention will be described in detail. Therefore, the description proposed herein is just a preferable example for the purpose of illustrations only, not intended to limit the scope of the invention, so it should be understood that other equivalents and modifications could be made thereto without departing from the spirit and scope of the invention.

MODE FOR THE INVENTION

Examples

Charge control agents were prepared to meet the conditions as listed in the following Table 1. Hereinafter, the charge control agents listed in the following Table 1 is dividedly represented by a charge control agent A and a charge control agent B.

TABLE 1

| | Kinds | Note |
|---|---|---|
| Charge control agent A | Aluminum azo metal complex | Negative |
| Charge control agent B | Styrene-acryl polymer | Negative |

Example 1

Use of Charge Control Agent A (1) Preparation of Core of Toner

An aqueous solution was prepared by dissolving 10 g of colloidal silica as a dispersant in 400 ml of distilled water in a 500 ml reactor, and warmed to a reaction temperature of 70° C.

Also, 105 g of a monomer mixture was prepared by adding 160 g of styrene, 36 g of butyl acrylate, 4 g of allylmethacrylate and 10 g of carbon black to another container, stirring the resulting mixture at a rotary speed of 2,000 rpm for 2 hours in a beads mill and removing beads. The prepared monomer mixture was put into a 70° C. water bath, and warmed. 5 g of paraffin wax was added to the warmed monomer mixture, and melted thoroughly for 20 minutes while stirring. 2 g of a polymerization initiator, azobisisobutyronitrile, was added to the thoroughly melted monomer mixture, and then stirred for 5 minutes to prepare a raw material for manufacturing a toner core.

The raw material was added to the previously prepared aqueous solution, and reacted at a rotary speed of 10,000 rpm for 20 minutes in a homogenizer while stirring. After the reaction for 20 minutes, the homogenized raw material was stirred at a rotary speed of 600 rpm for 15 minutes in a conventional stirring machine, and suspension-polymerized to produce a toner core.

(2) Formation of Shell Layer 20 g of styrene as a monomer, 0.12 g of divinylbenzene as a crosslinking agent, 0.4 g of azobisisobutyronitrile as a polymerization initiator, and 2 g of a charge control agent A were put into a beaker, and stirred sufficiently with a magnetic bar. Then, the resulting mixture was added to solution including the toner core prepared in the step (1) in the 500 ml reactor, and stirred at 70° C. at a rotary speed of 600 rpm for 10 hours in a conventional stirring machine to prepare a shell, thereby producing a final toner.

(3) Post-Processing Operation

The final toner was repeatedly washed thoroughly with water and filtered to remove a dispersant, and the dispersant-free suspension was dried under vacuum to produce a toner.

Example 2

Use of Charge Control Agent B

A toner was produced in the same manner as in Example 1, except that the charge control agent B was used as the charge control agent.

Comparative example 1

Use of Charge Control Agent A (1) Preparation of Core of Toner

This comparative example is a synthetic example in which a toner is produced by adding the charge control agent A to the toner core without forming a shell layer, and polymerizing the toner core.

An aqueous solution was prepared by dissolving 10 g of colloidal silica as a dispersant in 400 ml of distilled water in a 500 ml reactor, and warmed to a reaction temperature of 70° C.

Also, 105 g of a monomer mixture was prepared by adding 160 g of styrene, 36 g of butyl acrylate, 4 g of allylmethacrylate, 0.02 g of n-dodecyl mercaptan, 2 g of a charge control agent A and 10 g of carbon black to another container, stirring the resulting mixture at a rotary speed of 2,000 rpm for 2 hours in a beads mill and removing beads. The prepared monomer mixture was put into a 70° C. water bath, and warmed. 5 g of paraffin wax was added to the warmed monomer mixture, and melted thoroughly for 20 minutes while stirring. 2 g of a polymerization initiator, azobisisobutyronitrile, was added to the thoroughly melted monomer mixture, and then stirred for 5 minutes to prepare a reaction solution. The reaction solution was added to the previously prepared aqueous solution, and reacted at a rotary speed of 10,000 rpm for 20 minutes in a homogenizer while stirring. After the reaction for 20 minutes, the homogenized reaction solution was stirred at a rotary speed of 600 rpm for 15 minutes in a conventional stirring machine to produce a toner core.

(2) Post-Processing Operation

The final toner was repeatedly washed thoroughly with water and filtered to remove a dispersant, and the dispersant-free suspension was dried under vacuum to produce a toner.

Comparative Example 2

Preparation of Toner Through the Addition of Charge Control Agent B to Core

Toner particles were produced in the same manner as in Comparative example 1, except that a styrene-acryl-based polymeric charge control agent (charge control agent B) containing a sulfonic acid group was used as the charge control agent.

Evaluation of Image Characteristics of Toners Prepared in Examples and Comparative Examples 2 parts by weight of silica surface-treated with an external additive was added respectively to the toners prepared in Example 1 and Comparative example 1 using the same charge control agent, and to the toners prepared in Example 2 and Comparative example 2 using the same charge control agent, and mixed at a rotary speed of 3000 rpm for 3 minutes in a blender to coat toner cores. Then, toner cartridges of an HP4600 printer (commercially available from Hewlett Packard) was filled respectively with the coated toners, and charges of the toners were measured according to the suction method of sucking in a toner that is charged by a doctor blade and a developer roller, thereby to measure charge amounts of the sucked toners. The results about image characteristics of the toners are listed in the following Table 2.

TABLE 2

| | Charge amount(μC/g) | Transfer property (%, 1000 sheets) | Fog(Background) |
|---|---|---|---|
| Example 1 | −15 | 88.3 | B |
| Comparative example 1 | −8.2 | 67.5 | D |
| Example 2 | −25 | 96.7 | A |
| Comparative example 2 | −16.2 | 88.2 | B |

A fog (background) phenomenon in an image was determined by observing a non-image region with the naked eye through an optical microscope. Background levels were represented by decreasing levels of D to A, wherein Level A means that a background does not appear at all, and Level D means that a background appears significantly.

As listed in the Table 2, it was revealed that the toners of Examples 1 and 2, in which a charge control agent is added to a shell layer, show high charge density when they are charged since the charge control agent is far more effectively distributed densely in surfaces of the ton ers than they are in the comparative examples even when the charge control agent is added to the toner in the same amount as in the comparative examples, indicating that the toners of Examples 1 and 2 have excellent transfer properties and low background level.

INDUSTRIAL APPLICABILITY

As described above, it was revealed that the toner having good charging characteristics according to the present invention can be effectively produced by distributing a charge control agent on the outermost thin shell layer of the toner according to the method including: polymerizing a toner core without adding a polymeric charge control agent together with other components in the polymerization of toner particles, followed by adding the charge control agent into the monomer that is used to form a rigid shell layer. The above-mentioned method may be easily used in industries since the method is applicable to the field of various applications without changing the conventional polymerization equipments.

The invention claimed is:

1. A method for manufacturing a toner having good charging characteristics, the method comprising:

producing a toner core using a suspension polymerization method;

preparing a suspension of toner particles having a core-shell structure by forming a rigid shell on a surface of the toner core; and recovering the toner particles from the suspension as a post-processing operation;

wherein the shell comprises a charge control agent (CCA), a styrene monomer selected from the group consisting of styrene, monochlorostyrene, methylstyrene and dimethylstyrene, and an oil-soluble polymerization initiator selected from the group consisting of bisisobutyronitrile and azobisdimethylvaleronitrile.

2. The method of claim 1, wherein the producing of the toner core comprises:

adding a dispersant and optionally an anionic surfactant to an aqueous solution so that raw materials for a toner core are present as fine colloidal particles prior to a polymerization process and preparing a monomer complex through a separate operation;

adding the monomer complex to the aqueous solution; and pulverizing the monomer complex into fine colloidal particles by applying a shearing force to the monomer complex in the aqueous solution and simultaneously polymerizing the pulverized fine colloidal particles.

3. The method of claim 2, wherein the dispersant is one or more selected from the group consisting of inorganic dispersants including calcium phosphate salt, magnesium salt, hydrophilic silica, hydrophobic silica and colloidal silica; non-ionic polymeric dispersants including polyoxyethylene alkylether, polyoxyalkylene alkylphenolether, sorbitan fatty acid ester, polyoxyalkylene fatty acid ester, glycerine fatty acid ester, polyvinyl alcohol, alkyl cellulose and polyvinyl pyrrolidone; and ionic polymeric dispersants including polyacrylamide, polyvinyl amine, polyvinyl amine N-oxide, polyvinyl ammonium salt, polydialkyldiallyl ammonium salt, polyacrylic acid, polystyrene sulfonic acid, polyacrylate, polystyrene sulfate and polyaminoalkyl acrylate and the dispersant is added in a content of 0.1 to 10% by weight, based on the total weight of the aqueous solution.

4. The method of claim 2, wherein the anionic surfactant is one or more selected from the group consisting of fatty acid salt, alkyl sulfuric ester salt, alkylaryl sulfuric ester salt, dialkyl sulfosuccinate and alkyl phosphate and the anionic surfactant is present in a content of 0 to 20% by weight, based on the total weight of the aqueous solution.

5. The method of claim 2, wherein the monomer complex comprises 30 to 90% by weight of an aromatic vinyl monomer, 5 to 30% by weight of one or more selected from the group consisting of acrylate monomer, methacrylate monomer and dien monomer, 0 to 30% by weight of an acidic or basic olefin monomer, 0.1-8% by weight of a molecular weight modifier, 1 to 20% by weight of a color pigment or carbon black, 0.01 to 30% by weight of wax, 0.001 to 10% by weight of a polar grafting agent, and 0.01 to 5% by weight of a polymerization initiator.

6. The method of claim 5, wherein the monomer complex is prepared by kneading all components except for the polymerization initiator, followed by further adding the polymerization initiator right before the suspension polymerization and kneading the resulting mixture.

7. The method of claim 5, wherein the aromatic vinyl monomer is one or more selected from the group consisting of styrene, monochlorostyrene, methylstyrene and dimethylstyrene;

the acrylate monomer is one or more selected from the group consisting of methylacrylate, ethylacrylate, n-butylacrylate, isobutylacrylate, dodecyl acrylate and 2-ethylhexylacrylate;

the methacrylate monomer is one or more selected from the group consisting of methyl methacrylate, ethyl methacrylate, n-butyl methacrylate, isobutyl methacrylate, dodecyl methacrylate and 2-ethylhexyl methacrylate;

the dien monomer is one or more selected from the group consisting of butadien and isoprene; and the acidic or basic olefin monomer is one or more selected from the group consisting of $\alpha,\beta$-ethylene compounds containing a carboxyl group; methacrylic acid esters, methacryl amides, vinyl amines, and diaryl amines of aliphatic alcohol containing amine or quaternary ammonium group; and ammonium salts thereof.

8. The method of claim 5, wherein the molecular weight modifier is one or more selected from the group consisting of mercaptan compounds including t-dodecyl mercaptan and n-dodecyl mercaptan.

9. The method of claim 5, wherein the pigment is one or more selected from the group consisting of inorganic pigments including metal powder type pigment, metal oxide type, carbon type, sulfide type, chromate type and ferrocyanide type pigments; and organic pigments including azo type, acid dye type, basic dye type, mordant dye type, phthalocyanine type, quinacridone type and dioxane type pigments.

10. The method of claim 5, wherein the wax is one or more selected from the group consisting of petroleum-refined wax including paraffin wax, microcrystalline wax and ceresin wax; natural wax including carnuba wax; and synthetic wax including polyethylene and polypropylene.

11. The method of claim 5, wherein the polar grafting agent is one or more selected from the group consisting of ethylene dimethacrylate, ethylene glycol dimethacrylate, diethylene glycol diacrylate, 1,6-hexamethylene diacrylate, allyl methacrylate, 1,1,1-trimethylol propane triacrylate and triallylamine.

12. The method of claim 1, wherein the polymerization initiator is one or more selected from the group consisting of azo initiators including bisisobutyronitrile and azobisdimethylvaleronitrile; organic peroxides including benzoyl peroxide and lauroyl peroxide; and water-soluble initiators including potassium persulfate and ammonium persulfate.

13. The method of claim 1, wherein the shell is prepared by adding 1 to 20 parts by weight of a styrene monomer (an additionally added monomer), 0 to 5 parts by weight of a crosslinking agent and 0.01 to 20 parts by weight of a charge control agent (CCA) (based on 100 parts by weight of the toner core), and 0.01 to 5 parts by weight of a polymerization initiator (based on 100 parts by weight of the monomer) to the suspension in which the toner core is formed; and reacting the resulting mixture while stirring.

14. The method of claim 13, wherein the crosslinking agent is divinylbenzene, arylmethacrylate or combination thereof.

15. The method of claim 1, wherein the charge control agent is one or more selected from the group consisting of cationic charge control agents including nigrosine dye, highly aliphatic metal salt, alkoxy amine, chelate, quaternary ammonium salt, alkylamide, fluorinated surfactant, metal salt of naphthalenic acid; anionic charge control agents including chlorinated paraffin, polyester, sulfonylamine of copper phthalocyanine, styrene-acryl polymer containing sulfonic acid group; and inorganic anionic charge control agents including chromium-containing azo metal complex, salicylic acid metal complex and chromium-containing organic dye.

16. The method of claim 1, wherein the post-processing operation comprises: separating the toner from the suspension by repeatedly washing the suspension including the toner with a core-shell structure to remove the dispersant from the suspension and filtering the dispersant-free suspension; and drying the toner in a vacuum oven.

* * * * *